US012551013B2

(12) United States Patent
Chang

(10) Patent No.: US 12,551,013 B2
(45) Date of Patent: Feb. 17, 2026

(54) LOCKER SYSTEM CAPABLE OF DYNAMICALLY GENERATING STORAGE SPACE BASED ON OBJECT VOLUME AND AN OPERATION METHOD THEREOF

(71) Applicant: Kai-Chieh Chang, Taipei (TW)

(72) Inventor: Kai-Chieh Chang, Taipei (TW)

( * ) Notice: Subject to any disclaimer, the term of this patent is extended or adjusted under 35 U.S.C. 154(b) by 321 days.

(21) Appl. No.: 18/371,430

(22) Filed: Sep. 21, 2023

(65) Prior Publication Data

US 2024/0108133 A1 Apr. 4, 2024

(30) Foreign Application Priority Data

Sep. 29, 2022 (TW) ..... 111136939

(51) Int. Cl.
*A47B 87/02* (2006.01)

(52) U.S. Cl.
CPC ..... *A47B 87/0292* (2013.01)

(58) Field of Classification Search
CPC ..... G07F 11/007; G07F 11/46; G07F 11/60; G07F 17/10; G07F 17/12; G07F 17/13; G06Q 10/08365; G06Q 10/083; G06Q 10/0836
See application file for complete search history.

(56) References Cited

U.S. PATENT DOCUMENTS

| | | | | |
|---|---|---|---|---|
| 8,919,637 | B2 * | 12/2014 | Kim | A47G 29/122 232/24 |
| 9,913,535 | B2 * | 3/2018 | Lin | A47B 57/00 |
| 2015/0302351 | A1 * | 10/2015 | Cassady | B65G 1/137 705/339 |
| 2018/0078992 | A1 * | 3/2018 | High | A47G 29/20 |

FOREIGN PATENT DOCUMENTS

| | | | | |
|---|---|---|---|---|
| CN | 204791302 | U * | 11/2015 | |
| CN | 105852458 | A * | 8/2016 | A47B 81/00 |
| CN | 205582133 | U * | 9/2016 | G07F 17/13 |
| CN | 107749128 | A * | 3/2018 | G07F 17/12 |
| CN | 110576786 | A * | 12/2019 | B60P 3/00 |
| CN | 213046011 | U * | 4/2021 | |
| GB | 2550442 | A * | 11/2017 | G07F 17/12 |
| WO | WO-2019161872 | A1 * | 8/2019 | H04W 3/00 |
| WO | WO-2020228309 | A1 * | 11/2020 | G07F 17/12 |
| WO | WO-2023281315 | A1 * | 1/2023 | G06Q 10/083 |

* cited by examiner

*Primary Examiner* — Andrew Roersma
(74) *Attorney, Agent, or Firm* — Chih Feng Yeh; Yongjean Consulting Inc.

(57) ABSTRACT

A locker system capable of dynamically generating a storage space based on an object volume and an operation method thereof are disclosed. In the locker system, at least one group of support members is disposed on a cabinet body to allow a user to select whether to dispose a detachable carrier; in order to place an stored object into the cabinet body, an object volume of the stored object is detected, the user is prompted to dispose the detachable carrier at a specified location inside the cabinet body based on the object volume, so that the interior space of the cabinet door can be dynamically partitioned to generate an appropriate storage space for placing the stored object, thereby achieving the technical effect of improving a space usage rate.

10 Claims, 9 Drawing Sheets

LOCKER SYSTEM CAPABLE OF DYNAMICALLY GENERATING STORAGE SPACE BASED ON OBJECT VOLUME AND AN OPERATION METHOD THEREOF

CROSS-REFERENCE STATEMENT

The present application is based on, and claims priority from, TAIWAN Patent Application Serial Number 111136939, filed Sep. 29, 2022, the disclosure of which is hereby incorporated by reference herein in its entirety.

BACKGROUND

1. Technical Field

The present invention relates to a smart locker system and an operation method thereof, and more particularly to a locker system capable of dynamically generating a storage space based on an object volume, and an operation method thereof.

2. Description of the Related Art

In recent years, with the popularity and vigorous development of the logistics industry, how to efficiently use storage spaces (also known as spaces of the locker system) has become one of the issues that various manufacturers are eager to solve.

Generally speaking, a conventional locker system uses pre-fixed storage spaces, and a stored object smaller than the size of the storage space can be placed in the storage space. However, this conventional locker system is difficult to effectively utilize the storage spaces. For example, when there is no smaller storage space, the stored object with a small size must be placed in an overly large storage space, so there is a problem of poor space utilization rate.

In view of this problem, some manufacturers have proposed technical means to change storage space; the proposed technical means is to control a shelf to adjust the sizes of the section spaces of the cabinet by a complex mechanism. However, the complex mechanism causes greatly increases in the overall volume, weight, and cost, and also causes higher failure rate and maintenance inconvenience, so the problem of poor space utilization rate is not effectively solved.

According to above-mentioned contents, what is needed is to develop an improved solution to solve the convention problem of a poor space utilization rate.

SUMMARY

An objective of the present invention is to disclose a locker system capable of dynamically generating a storage space based on an object volume and an operation method thereof, to solve the convention problem of a poor space utilization rate.

In order to achieve the objective, the present invention discloses a locker system capable of dynamically generating a storage space based on an object volume, and the locker system includes a cabinet body and a computer device.

The cabinet body includes an interior space, a front panel, and at least one group of support members, wherein the front panel has cabinet doors, the at least one group of support members is disposed on inner sides of two side plates of the cabinet body, and each of the at least one group of support members is not provided with a detachable carrier in initial.

The computer device is connected to the cabinet body and includes a section space calculation module, a section space selection module, and a confirmation module. The section space calculation module is configured to calculate at least one storage space formed by partitioning the interior space by the detachable carrier based on a location of the detachable carrier, and detect a quantity, a size and a usage status of the at least one storage space to generate a section space status. The section space selection module is connected to the section space calculation module, and configured to detect the object volume of a stored object before the stored object is placed into the cabinet body, select one of the unused storage spaces larger than the object volume of the stored object based on the section space status, unlock N+1 cabinet doors corresponding to the selected storage space, and prompt a specified location for disposing the detachable carrier based on a height of the stored object to partition the interior space to generate the different storage space, wherein N is a positive integer. The confirmation module is connected to the section space calculation module and the section space selection module, wherein when the N+1 cabinet doors are detected to be closed and the stored object is placed in the selected storage space and the detachable carrier disposed newly is detected, the confirmation module drives the section space calculation module to calculate and detect the storage space to update the section space status and switch statuses of the N+1 cabinet doors to locked statuses.

In order to achieve the objective, the present invention discloses a locker system capable of dynamically generating a storage space based on an object volume, the locker system includes a cabinet body and a computer device. The cabinet body include an interior space, a front panel, and at least one group of support members, wherein the front panel has cabinet doors, the at least one group of support members is disposed on inner sides of two side plates of the cabinet body, each of the at least one group of support members is not provided with a detachable carrier in initial. The computer device is connected to the cabinet body, and includes a section space calculation module, a section space selection module and a confirmation module. The section space calculation module is configured to continuously calculate at least one storage space which is remaining and available, based on a space occupied by at least one stored object placed in the interior space, and detect a quantity and a size of the at least one storage space to generate a section space status. The section space selection module is connected to the section space calculation module, wherein before a stored object is placed, the section space selection module is configured to detect the object volume of the stored object, select one of the storage spaces larger than the object volume of the stored object, based on the section space status, and open N cabinet doors corresponding to the selected storage space, wherein N is a positive integer. The confirmation module is connected to the section space calculation module and the section space selection module, wherein when the detachable carrier does not exist on a bottom of the selected storage space, the confirmation module prompts to dispose the detachable carrier on the bottom of the selected storage space, and when the N cabinet doors are closed, the confirmation module drives the section space calculation module to calculate and detect the storage space to update the section space status.

In order to achieve the objective, the present invention discloses an operation method of a locker system capable of dynamically generating a storage space based on an object volume, the operation method is applied in an environment where a cabinet body and a computer device are disposed, the cabinet body includes an interior space, the operation method includes steps of: disposing cabinet doors on a front panel of the cabinet body, disposing at least one group of support members on inner sides of two side plates of the cabinet body, wherein each of the at least one group of support members is not provided with a detachable carrier in initial; calculating at least one storage space generated by partitioning the interior space by the detachable carrier based on a location of the detachable carrier, and detecting a quantity, a size and a usage status of the at least one storage space to generate a section space status, by the computer device; before a stored object is placed into the cabinet body, detecting the object volume of the stored object, selecting one of the unused storage spaces larger than the object volume of the stored object based on the section space status, unlocking N+1 cabinet doors corresponding to the selected storage space, prompting a specified location for disposing the detachable carrier to partition the interior space to generate the different storage space based on a height of the stored object, by the computer device, wherein N is a positive integer; when the N+1 cabinet doors are detected to be closed and the stored object is placed in the selected storage space and the detachable carrier disposed newly is detected, calculating and detecting the storage space to update the section space status, and switching statuses of the N+1 cabinet doors to locked statuses, by the computer device.

In order to achieve the objective, the present invention discloses an operation method of a locker system capable of dynamically generating a storage space based on an object volume, the operation method is applied in an environment where a cabinet body and a computer device are disposed, the cabinet body includes an interior space, the operation method includes steps of: disposing cabinet doors on a front panel of the cabinet body, disposing at least one group of support members on inner sides of two side plates of the cabinet door, wherein each of the at least one group of support members is not provided with a detachable carrier in initial; continuously calculating at least one storage space which is remaining and available based on a space occupied by at least one stored object placed in the interior space, and detecting a quantity and a size of the at least one storage space to generate a section space status, by the computer device; before a stored object is placed, detecting the object volume of the stored object, selecting one of the storage spaces larger than the object volume of the stored object based on the section space status, and opening N cabinet doors corresponding to the selected storage space, by the computer device, wherein N is a positive integer; when the detachable carrier does not exist on a bottom of the selected storage space, prompting to dispose the detachable carrier on the bottom of the selected storage space, and when the N cabinet doors are closed, calculating and detecting the storage space to update the section space status, by the computer device.

According to the above-mentioned systems and operation methods of the present invention, the difference between the present invention and the conventional technology is that, in the present invention, the at least one group of support members is disposed on the cabinet body to allow a user to select whether to dispose the detachable carrier; in order to place the stored object into the cabinet body, the object volume of the stored object is detected, the user is prompted to dispose the detachable carrier at the specified location inside the cabinet body based on the object volume, so that the interior space of the cabinet door can be dynamically partitioned to generate an appropriate storage space for placing the stored object.

Therefore, the above-mentioned solution of the present invention is able to achieve the technical effect of improving a space usage rate.

BRIEF DESCRIPTION OF THE DRAWINGS

The structure, operating principle and effects of the present invention will be described in detail by way of various embodiments which are illustrated in the accompanying drawings.

DETAILED DESCRIPTION

Figure 1A:
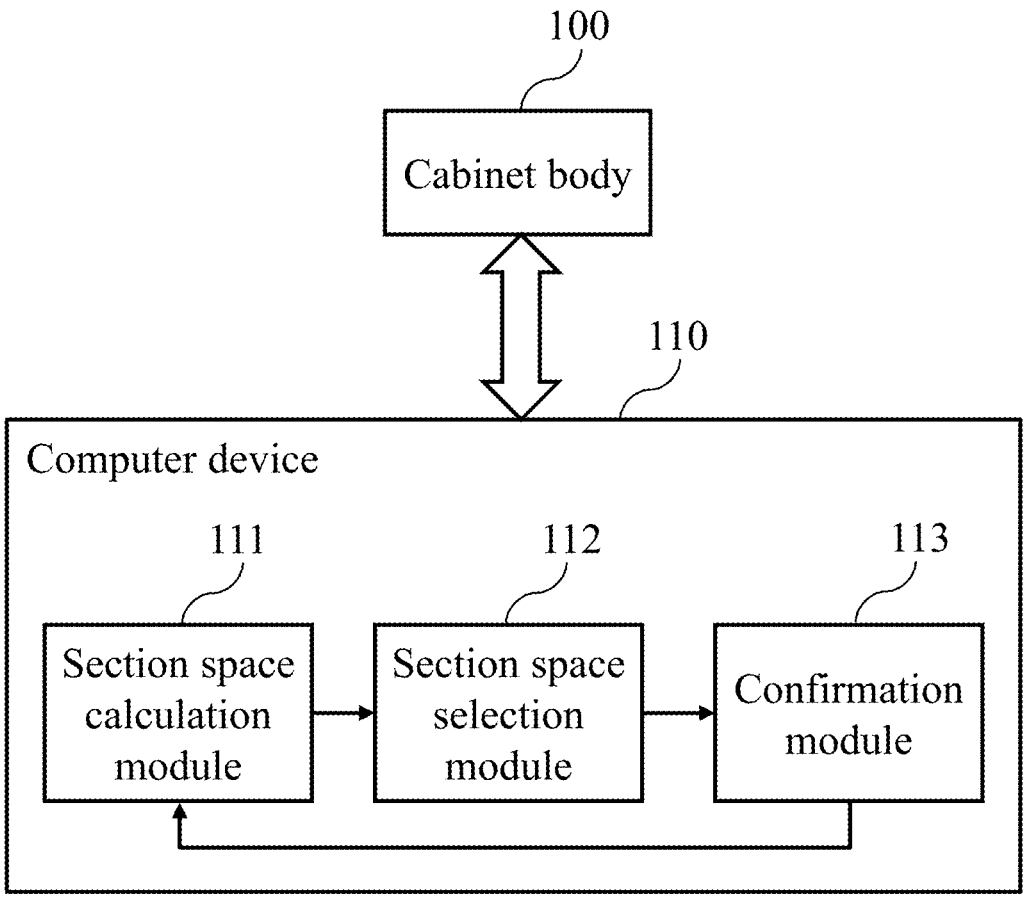
FIG. 1A is a block diagram of a first embodiment of a locker system capable of dynamically generating a storage space based on an object volume, according to the present invention.

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims.

These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts. As used herein, the singular forms "a", "an" and "the" are intended to include the plural forms as well, unless the context clearly indicates otherwise.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the words "comprise" and "include", and variations such as "comprises", "comprising", "includes", or "including", will be acknowledged to imply the inclusion of stated elements but not the exclusion of any other elements.

The terms self-defined in the present invention are descripted before illustration of the locker system capable of dynamically generating a storage space based on an object volume and an operation method. The locker system of the present invention means a smart object storage cabinet with detection, calculation and control functions, and needs electrical power supply for normal functioning. The locker system includes a cabinet body, and a computer device having a section space calculation module, a section space selection module, and a confirmation module. The electrical power supply can be from commercial power, a power bank, a battery, solar apparatus or the like. The locker system will be illustrated in detail with reference to embodiments and drawing figures in the following paragraphs.

The locker system capable of dynamically generating a storage space based on an object volume and the operation method thereof will hereinafter be described in more detail with reference to the accompanying drawing figures. Please refer to FIG. 1A, which is a block diagram of a first embodiment of a locker system capable of dynamically generating a storage space based on an object volume, according to the present invention. As shown in FIG. 1A, the locker system includes a cabinet body 100 and a computer device 110. The cabinet body 100 includes an interior space, a front panel and at least one group of support members. The front panel has cabinet doors, the at least one group of support members is disposed on inner sides of two side plates of the cabinet body 100, and each of the at least one group of support members is not provided with a detachable carrier in initial. In actual implementation, the cabinet doors can be left-opening/right-opening pulling doors/sliding doors or the like, each group of the support members includes a pair of recessed tracks and an engagement device, recessed openings of the recessed tracks face to each other in parallel, a width of the recessed opening is 2M cm, and a thickness of the detachable carrier is M cm, M is a positive integer. When the detachable carrier is fully placed into the pair of recessed tracks, the engagement device is engaged with the detachable carrier. In another embodiment, the support member can be an L-shaped support member, each of two vertical sides of the detachable carrier has a recessed part, the recessed part is configured to connect to an extension part at a bottom of the L-shaped support member, and the detachable carrier can be inserted or pulled out along the support member in a horizontal axis. The details of the structure will be illustrated with reference to the accompanying drawings in the following paragraphs. In an embodiment, the computer device 110 can be disposed inside or outside the cabinet body 100, or remotely linked to the cabinet body 100. It is particularly noted that the detachable carrier can be a mesh or a folding plate pre-placed in the cabinet body 100. Besides, the cabinet bodies 100 with different sizes (such as different lengths, widths or depths) can be provided to connect the computer device 110, so that the cabinet bodies 100 can be applied to different object volumes.

The computer device 110 is connected to the cabinet body 100 and includes a section space calculation module 111, a section space selection module 112, and a confirmation module 113. The section space calculation module 111 is configured to calculate a storage space generated by partitioning the interior space by the detachable carrier, based on a location of the detachable carrier, and also detect a quantity, a size and a usage status of the storage space to generate a section space status. In actual implementation, the location of the detachable carrier can be continuously detected and confirmed through the detection device installed inside the cabinet body 100; or the required storage space and the location of the corresponding detachable carrier can be calculated based on size data in database. The detection device can be a sensor, and transmit data through WiFi and ZigBee, constrained application protocol, message queuing telemetry transport (MQTT), similar wireless transmission technology.

The section space selection module 112 is connected to the section space calculation module 111. Before a stored object is placed, the section space selection module 112 detects an object volume of the stored object, and selects one of the unused storage spaces larger than the object volume of the stored object based on the section space status, unlocks the N+1 cabinet doors corresponding to the selected storage space, prompts a specified location for disposing the detachable carrier to partition the interior space to generate the different storage space, based on a height of the stored object, wherein N is a positive integer. In actual implementation, the object volume of the stored object can be detected by using at least one of a radar ranging module, an image recognition module and mechanical tool to measure a length, a width and a height of the stored object to calculate the object volume, or directly detecting a volume value inputted through a mobile application program or a GUI. When selecting the storage space, the section space selection module 112 filters out unused storage spaces larger than the object volume of the stored object, selects the unused storage space having minimal volume; when the detachable carrier exists above the selected storage space, it indicates that the above storage space may be in use, even the above storage space is not in use, because the detachable carrier has been disposed, it is not necessary to dispose the detachable carrier again, so the section space selection module 112 can prohibit the highest one among the N+1 cabinet doors from being opened, and open the cabinet doors just for taking out the stored object in the storage space. It further explains that the specified location can be between upper edges and lower edges of the highest and the second highest ones among the opened cabinet doors, and this scheme will be illustrated in detail with reference to the accompanying drawings in the following paragraphs. It is particularly noted that, for example, in a condition that the cabinet body 100 has 3 cabinet doors numbered 1, 2 and 3 from top to bottom, when the selected storage space corresponds to the cabinet doors numbered 2 and 3, the "N+1 cabinet doors" means N is 2 and represents the two cabinet doors numbered 2 and 3, and "1" represents the above cabinet door numbered 1. In other words, "+1" represents the cabinet door above the storage space by one layer.

The confirmation module 113 is connected to the section space calculation module 111 and the section space selection module 112. When the N+1 cabinet doors are detected to be closed and the stored object is placed in the selected storage space and the detachable carrier disposed newly is detected, the confirmation module 113 drives the section space calculation module 111 to calculate and detect the storage space to update the section space status, and switches the statuses of the N+1 closed cabinet doors to locked statuses. In actual implementation, a sensor mounted on the cabinet body or the cabinet door can be used to detect whether the N cabinet doors are closed; the sensor can be, for example, a pressure-sensitive sensor, a light-sensitive sensor or other sensor capable of detecting whether the cabinet door is closed; the sensor even can detect whether the detachable carrier is fastened; when the detachable carrier is detected to be fastened already, it indicates that the detachable carrier is newly disposed.

Figure 1B:
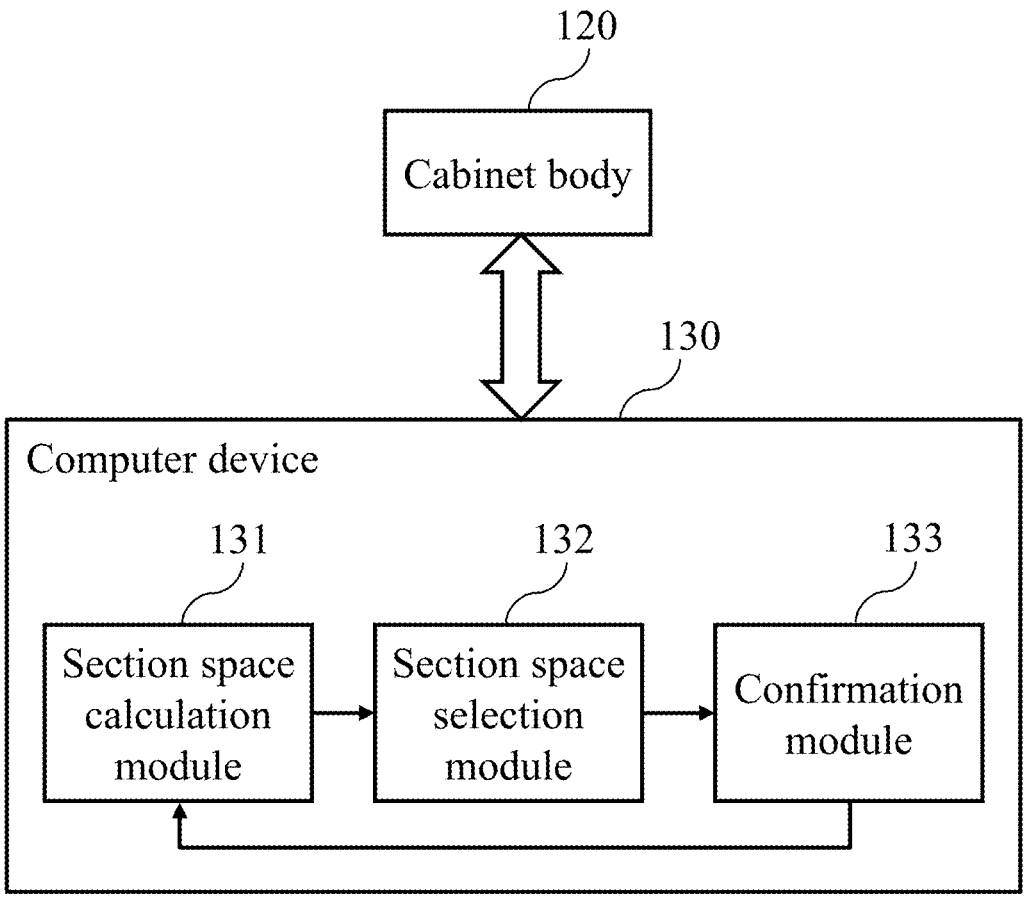
FIG. 1B is a block diagram of a second embodiment of a locker system capable of dynamically generating a storage space based on an object volume, according to the present invention.

Please refer to FIG. 1B, which is a block diagram of a second embodiment of a locker system capable of dynamically generating a storage space based on an object volume, according to the present invention. As shown in FIG. 1B, the locker system includes a cabinet body 120 and a computer device 130, the cabinet body 120 is the same as the cabinet body 100 of FIG. 1A, so the detailed description is not repeated herein. The computer device 130 includes a section space calculation module 131, a section space selection module 132, and a confirmation module 133. The section space calculation module 131 is configured to continuously calculate the remaining available storage space based on the space occupied by the stored object placed in the interior space, and detect a quantity and size of the storage space to generate a section space status. In actual implementation, different sensors can be used to sense the space occupied by the stored object in the interior space, for example, a light occlusion sensor can be used to sense a height of the stored object to calculate a remaining height of the cabinet body 120 and calculate the remaining available storage space.

The section space selection module 132 is connected to the section space calculation module 131. Before a stored object is placed, the section space selection module 132 detects the object volume of the stored object, selects one of storage space greater than the object volume of the stored object based on the section space status, and opens the N cabinet doors corresponding to the selected storage space, N is a positive integer. The main difference between the second embodiment and the first embodiment is that the section space selection module 112 of the first embodiment opens N+1 cabinet doors, and the section space selection module 132 of the second embodiment opens the N cabinet doors; in other words, the second embodiment does not need to open the additional cabinet door above the N cabinet doors for inserting the detachable carrier.

The confirmation module 133 is connected to the section space calculation module 131 and the section space selection module 132. When the detachable carrier does not exist on a bottom of the selected storage space, the confirmation module 133 prompts to dispose the detachable carrier on a bottom of the selected storage space. When the N cabinet doors are closed, the confirmation module 133 drives the section space calculation module 131 to calculate and detect the storage space to update the section space status. The different between the confirmation module 133 and the confirmation module 113 is that when the detachable carrier does not exist on the bottom of the selected storage space, the confirmation module 133 prompts the user to dispose the detachable carrier on the bottom of the storage space, so as to provide the carrier for placing another stored object next time.

It is to be particularly noted that, in actual implementation, the modules of the present invention can be implemented by various manners, including software, hardware or any combination thereof, for example, in an embodiment, the module can be implemented by software and hardware, or one of software and hardware. Furthermore, the present invention can be implemented fully or partly based on hardware, for example, one or more module of the system can be implemented by integrated circuit chip, system on chip (SoC), a complex programmable logic device (CPLD), or a field programmable gate array (FPGA). The concept of the present invention can be implemented by a system, a method and/or a computer program. The computer program can include computer-readable storage medium which records computer readable program instructions, and the processor can execute the computer readable program instructions to implement concepts of the present invention. The computer-readable storage medium can be a tangible apparatus for holding and storing the instructions executable of an instruction executing apparatus. Computer-readable storage medium can be, but not limited to electronic storage apparatus, magnetic storage apparatus, optical storage apparatus, electromagnetic storage apparatus, semiconductor storage apparatus, or any appropriate combination thereof. More particularly, the computer-readable storage medium can include a hard disk, an RAM memory, a read-only-memory, a flash memory, an optical disk, a floppy disc or any appropriate combination thereof, but this exemplary list is not an exhaustive list. The computer-readable storage medium is not interpreted as the instantaneous signal such a radio wave or other freely propagating electromagnetic wave, or electromagnetic wave propagated through waveguide, or other transmission medium (such as optical signal transmitted through fiber cable), or electric signal transmitted through electric wire. Furthermore, the computer readable program instruction can be downloaded from the computer-readable storage medium to each calculating/processing apparatus, or downloaded through network, such as internet network, local area network, wide area network and/or wireless network, to external computer equipment or external storage apparatus. The network includes copper transmission cable, fiber transmission, wireless transmission, router, firewall, switch, hub and/or gateway. The network card or network interface of each calculating/processing apparatus can receive the computer readable program instructions from network, and forward the computer readable program instruction to store in computer-readable storage medium of each calculating/processing apparatus. The computer program instructions for executing the operation of the present invention can include source code or object code programmed by assembly language instructions, instruction-set-structure instructions, machine instructions, machine-related instructions, micro instructions, firmware instructions or any combination of one or more programming language. The programming language include object oriented programming language, such as Common Lisp, Python, C++, Objective-C, Smalltalk, Delphi, Java, Swift, C#, Perl, Ruby, and PHP, or regular procedural programming language such as C language or similar programming language. The computer readable program instruction can be fully or partially executed in a computer, or executed as independent software, or partially executed in the client-end computer and partially executed in a remote computer, or fully executed in a remote computer or a server.

Figure 2A:
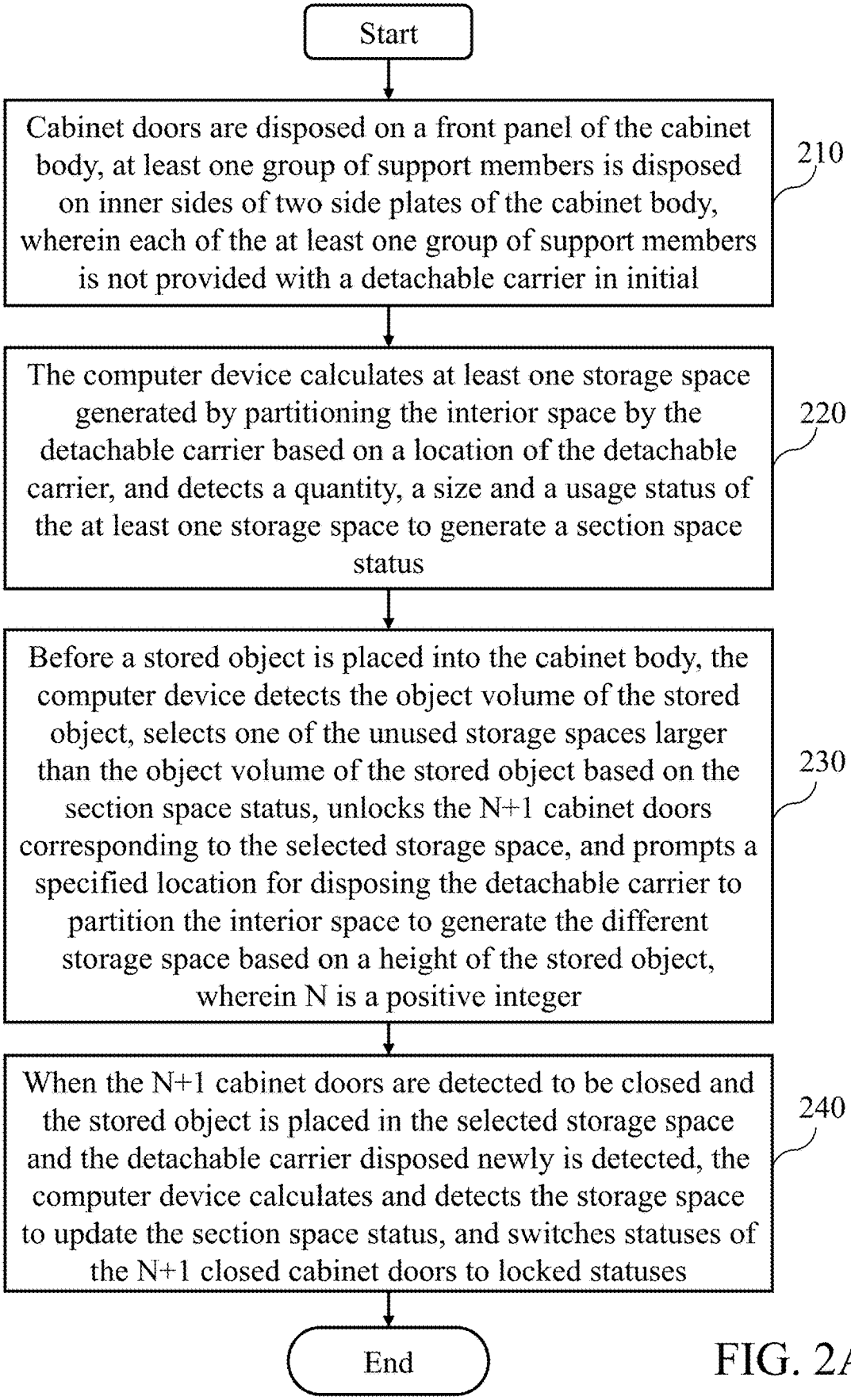
FIG. 2A is a flowchart of a first embodiment of an operation method of locker system capable of dynamically generating a storage space based on an object volume, according to the present invention.

Please refer to FIG. 2A, which is a flowchart of a first embodiment of an operation method of a locker system capable of dynamically generating a storage space based on an object volume, according to the present invention. The operation method is applied in environment where a cabinet body 100 and a computer device 110 are disposed, the cabinet body 100 includes an interior space, and the operation method includes the following steps. In a step 210, cabinet doors are disposed on a front panel of the cabinet body 100, at least one group of support members is disposed on inner sides of two side plates of the cabinet body 100, wherein each of the at least one group of support members is not provided with a detachable carrier in initial. In a step 220, the computer device calculates at least one storage space generated by partitioning the interior space by the detachable carrier based on a location of the detachable carrier, and detects a quantity, a size and a usage status of the at least one storage space to generate a section space status. In a step 230, before a stored object is placed into the cabinet body, the computer device detects the object volume of the stored object, selects one of the unused storage spaces larger than the object volume of the stored object based on the section space status, unlocks the N+1 cabinet doors corresponding to the selected storage space, and prompts a specified location for disposing the detachable carrier to partition the interior space to generate the different storage space based on a height of the stored object, wherein N is a positive integer. In a step 240, when the N+1 cabinet doors are detected to be closed and the stored object is placed in the selected storage space and the detachable carrier disposed newly is detected, the computer device calculates and detects the storage space to update the section space status, and switches statuses of the N+1 closed cabinet doors to locked statuses. Through aforementioned steps, at least one group of support members is disposed on the cabinet body 100 to allow a user to select whether to dispose the detachable carrier; in order to place an stored object, the object volume of the stored object is detected, the user is prompted to dispose the detachable carrier at the specified location inside the cabinet body 100 based on the object volume, so that the interior space of the cabinet body 100 can be dynamically partitioned to generate an appropriate storage space for placing the stored object. The situation where the first embodiment is applied is to access the stored object in self-service; when the stored object is placed for the first time, the detachable carrier must be disposed at the specified location for other user to place another stored object.

Figure 2B:
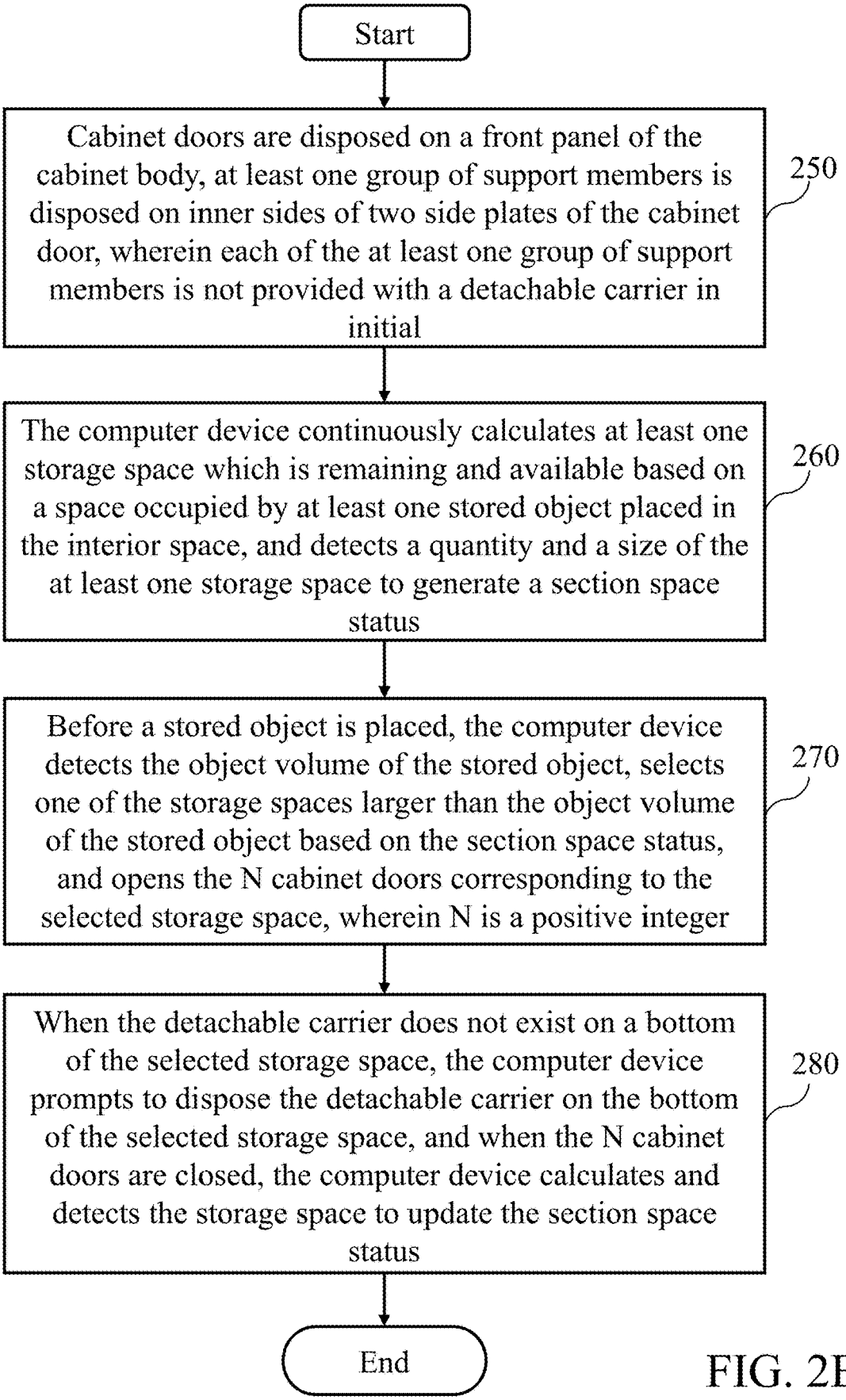
FIG. 2B is a flowchart of a second embodiment of an operation method of a locker system capable of dynamically generating a storage space based on an object volume, according to the present invention.

Please refer to FIG. 2B, which is a flowchart of a second embodiment of an operation method of a locker system capable of dynamically generating a storage space based on an object volume, according to the present invention. The operation method is applied in environment where a cabinet body 120 and a computer device 130 are disposed, the cabinet body 120 has an interior space, and the operation method includes the following steps. In a step 250, cabinet doors are disposed on a front panel of the cabinet body 120, at least one group of support members is disposed on inner sides of two side plates of the cabinet body 120, wherein each of the at least one group of support members is not provided with a detachable carrier in initial. In a step 260, the computer device continuously calculates at least one storage space which is remaining and available based on a space occupied by at least one stored object placed in the interior space, and detects a quantity and a size of the at least one storage space to generate a section space status. In a step 270, before a stored object is placed, the computer device detects the object volume of the stored object, selects one of the storage spaces larger than the object volume of the stored object based on the section space status, and opens the N cabinet doors corresponding to the selected storage space, wherein N is a positive integer. In a step 280, when the detachable carrier does not exist on a bottom of the selected storage space, the computer device prompts to dispose the detachable carrier on the bottom of the selected storage space, and when the N cabinet doors are closed, the computer device calculates and detects the storage space to update the section space status. Compared with the first embodiment of FIG. 2A, the situation where the second embodiment is applied is that the user placing the stored object is a trusted person, and the main difference between the first embodiment and the second embodiment is that in the second embodiment the detachable carrier does not need to be disposed when the stored object is placed for the first time, it just needs to dispose the detachable carrier at the bottom of the selected storage space when the user places another stored object for the second time.

Figure 3:
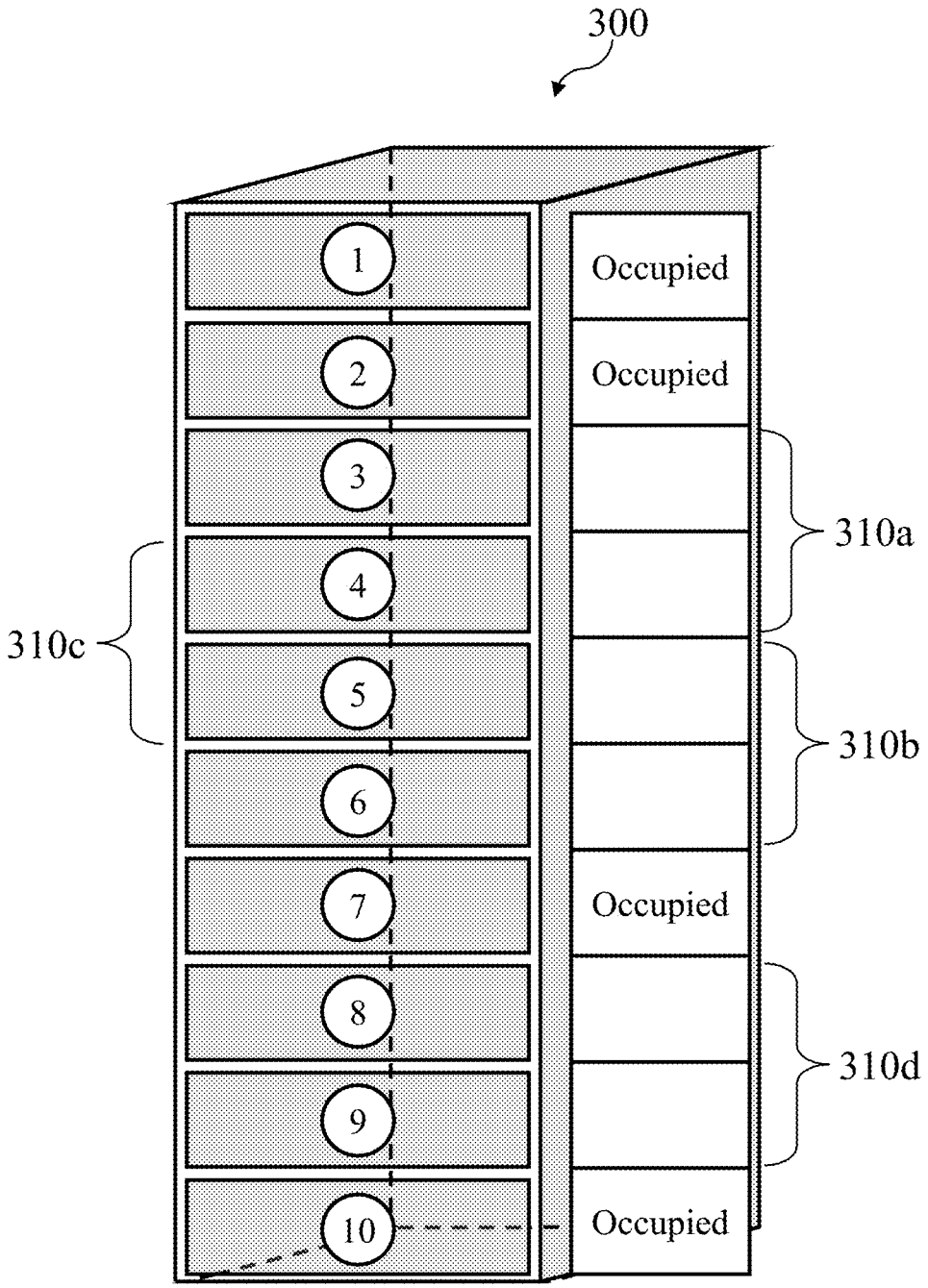
FIG. 3 is a schematic view of an operation of selecting a storage space, according to an application of the present invention.

The embodiment will be illustrated with reference to FIG. 3 to FIG. 7. Please refer to FIG. 3, which is a schematic view of an operation of selecting a storage space, according to an application of the present invention. The computer device 110 calculates a storage space generated by partitioning the interior space by the detachable carrier, based on the location of the detachable carrier, and detects a quantity, a size and a usage status of the storage space to generate a section space status. In order to place a new item (that is, the stored object), the computer device 110 detects the object volume of the stored object through a detection device, selects one of the unused storage spaces larger than the object volume of the stored object based on the current section space status, and unlocks N+1 cabinet doors corresponding to the selected storage space. For example, as shown in FIG. 3, the cabinet body 300 has ten cabinet doors numbered 1 to 10, when there are stored objects placed in the four cabinet doors numbered 1, 2, 7 and 10, it indicates these storage spaces are in use or occupied. When the stored object to be placed needs a storage space with a height of two cabinet doors, after the occupied storage spaces are excluded, the computer device 110 selects one of the detected storage spaces 310*a*-310*d*; in actual implementation, the storage space 310*d* is selected in priority, the storage spaces 310*a*-310*c* are not selected because they can form a larger storage space, so that these storage spaces can be reserved for other higher object later.

Figure 4:
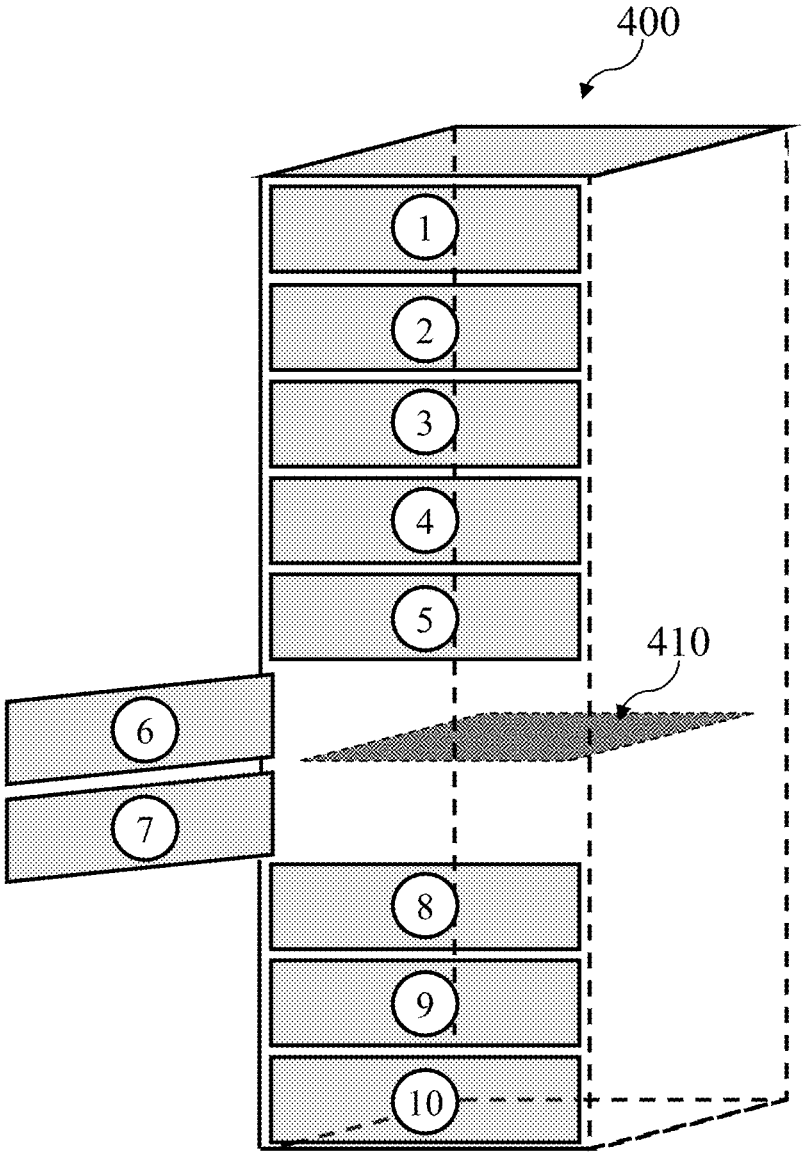
FIG. 4 is a schematic view of an operation of disposing a detachable carrier, according to an application of the present invention.

As shown in FIG. 4, which is a schematic view of an operation of disposing a detachable carrier, according to an application of the present invention. In initial, no detachable carrier 410 is disposed in the cabinet body 400 in advance; when the user wants to place a stored object with a height of four section spaces, the computer device 110 selects the storage space formed by the cabinet doors numbered 7 to 10 for the user to place the stored object; in this case, the space above the selected storage space is not in use, so the computer device 110 unlocks multiple cabinet doors (that is, the cabinet doors numbered 6 to 10) corresponding to the selected storage space, and prompts a specified location for disposing the detachable carrier 410, that is, the specified location is between the cabinet doors numbered 6 and 7 in this example. The specified location including the numbers of the cabinet doors can be outputted through SMS or a displayer. It is particularly noted that the reason of unlocking the cabinet doors numbered 6 to 10 but not the cabinet doors numbered 7 to 10 is that the cabinet door numbered 6 must be opened when the user wants to dispose the detachable carrier 410 between the cabinet doors numbered 6 and 7; in other words, the total height of the multiple cabinet doors corresponding to the selected storage space is higher than the storage space by a layer (that is, one more cabinet door). When a detachable carrier 410 exists above the selected storage space, it indicates that the above storage space is in use possibly, and it is unnecessary to dispose the detachable carrier 410, for the safety of picking up item, the cabinet door numbered 6 is prohibited from being opened in this example, that is, the highest one of the cabinet doors is prohibited from being opened.

Figure 5:
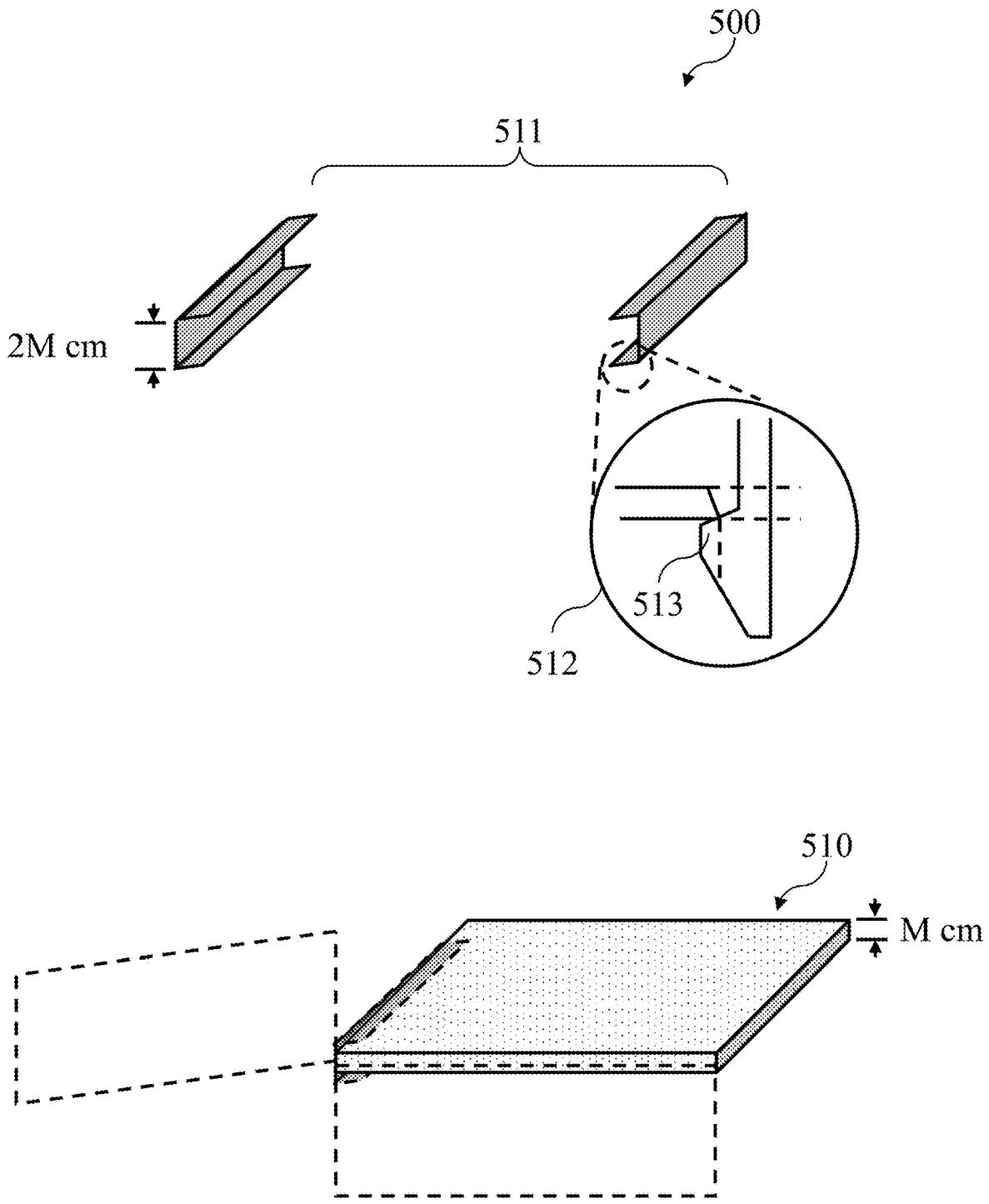
FIG. 5 is a schematic view of a support member, according to an application of the present invention.

Please refer to FIG. 5, which is a schematic view of a support member, according to an application of the present invention. In actual implement action, the support member 500 includes a pair of recessed tracks 511 and an engagement device 512, the recessed openings of the recessed tracks 511 face to each other in parallel, a width of the recessed opening is 2M cm, and a thickness of the detachable carrier 510 is M cm, wherein M is a positive integer. When the detachable carrier 510 is fully placed into the pair of recessed tracks 511, the engagement device 512 is engaged with the detachable carrier 510. For example, when a width of the recessed opening is 3 cm, a thickness of the detachable carrier 510 is 1.5 cm. When a sender places the detachable carrier 510 along the recessed track 511 and presses the detachable carrier 510 downwardly to make the engagement device 512 be engaged with the detachable carrier 510; due to an engagement part 513 is shown in FIG. 5, after the detachable carrier 510 is engaged with the engagement device 512, the detachable carrier 510 cannot be lifted up, and the below cabinet door is closed, so the detachable carrier 510 cannot be pulled out along the recessed track 511; in other words, the detachable carrier 510 is disposed between upper edges and lower edges of the highest and the second highest ones among the opened cabinet doors. On the other hand, when the below cabinet door is opened, the engagement device 512 can be pushed upward from the bottom, and the user is unable to flip the detachable carrier 510 due to the obstruction of the recessed track 511, so that the security of storing item in each storage space can be ensured.

Figure 6:
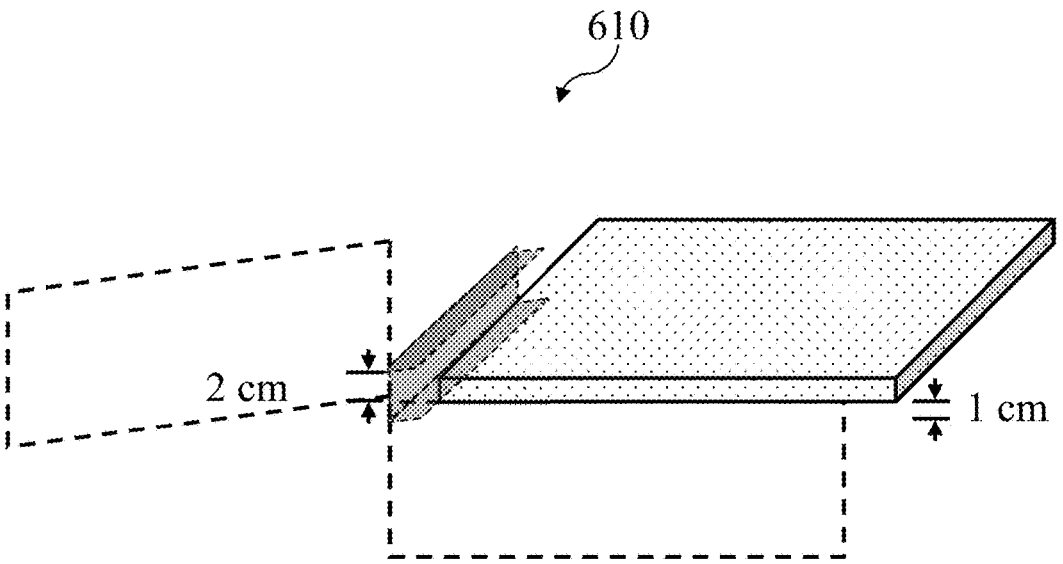
FIG. 6 is a schematic view of an operation of disposing a detachable carrier between upper edges and lower edges of two cabinet doors, according to an application of the present invention.
Figure 6:
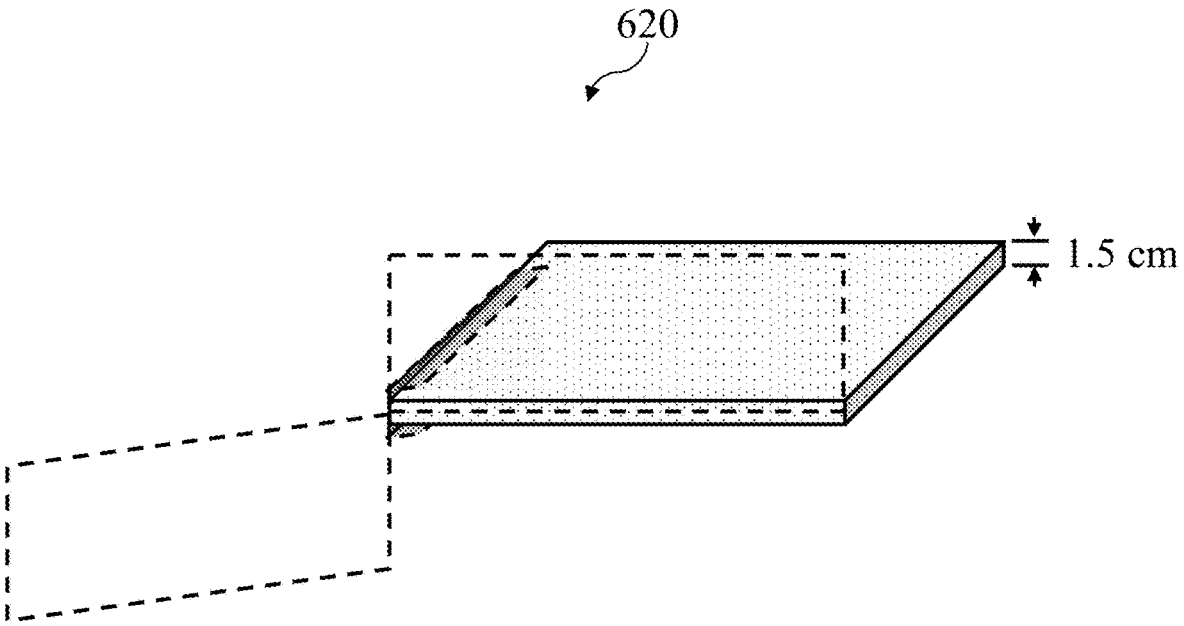

As shown in FIG. 6, which is a schematic view of an operation of disposing a detachable carrier between upper edges and lower edges of two cabinet doors, according to an application of the present invention. For example, a width of the recessed opening can be 3 cm, a thickness of the detachable carrier can be 1.5 cm; in actual implementation, in a first situation 610 where the above cabinet door is opened and the below cabinet door is closed, the detachable carrier can be smoothly placed and downwardly pressed to engage with the engagement device, in this case, it is difficult for the user to take out the detachable carrier because the 1 cm part of the detachable carrier is blocked by the below cabinet door. On the other hand, in a second situation 620 where the above cabinet door is closed and the below cabinet door is opened, the detachable carrier is blocked by the above cabinet door, and the user is unable to upwardly push the detachable carrier from the storage space of single below cabinet door.

Figure 7:
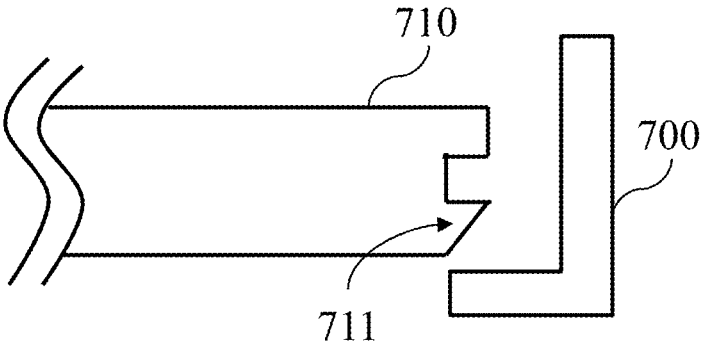
FIG. 7 is a schematic view of a L-shaped support member and a corresponding detachable carrier, according to an application of the present invention.
Figure 7:
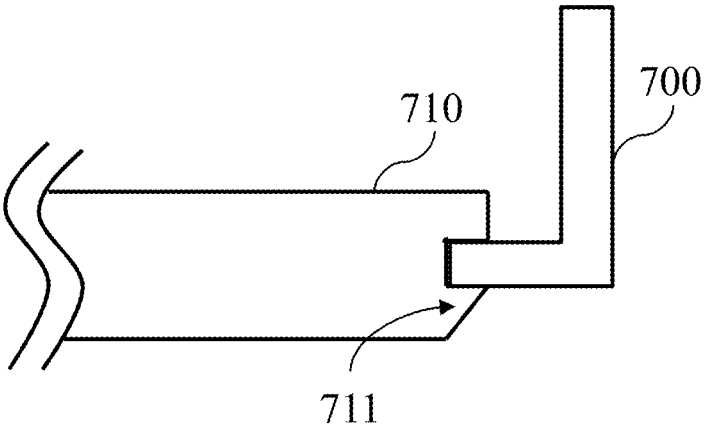

As shown in FIG. 7, which is a schematic view of an L-shaped support member and a corresponding detachable carrier, according to an application of the present invention. In actual implementation, besides the support member 500 shown in FIG. 5, an L-shaped support member 700 can be used with the corresponding detachable carrier 710. The upper part of FIG. 7 is a schematic view showing the detachable carrier 710 which is not disposed completely, the user can downwardly press the detachable carrier 710 to make the engagement device 711 retract inwardly; the lower part of FIG. 7 shows that the recessed part is engaged with the L-shaped support member 700 and the engagement device 711 recovers at the same time. In order to take out the detachable carrier 710, in a condition that the cabinet door corresponding to the L-shaped support member 700 is opened, the detachable carrier 710 can be directly pulled out along the cabinet body. Similarly, in the same condition, in order to dispose the detachable carrier 710, the recessed part of the detachable carrier 710 can be directly engaged with an extension part on the bottom of the L-shaped support member 700, and the detachable carrier 710 can be inserted along a horizontal axis to complete the disposing operation.

According to above-mentioned contents, the difference between the present invention and the conventional technology is that, in the present invention, the at least one group of support members is disposed on the cabinet body to allow a user to select whether to dispose the detachable carrier; in order to place the stored object into the cabinet body, the object volume of the stored object is detected, the user is prompted to dispose the detachable carrier at the specified location inside the cabinet body based on the object volume, so that the interior space of the cabinet door can be dynamically partitioned to generate an appropriate storage space for placing the stored object. Therefore, the above-mentioned technical solution of the present invention is able to solve the convention problem and achieve the technical effect of improving a space usage rate.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. A locker system capable of dynamically generating a storage space based on an object volume, and the locker system comprising:

a cabinet body, comprising an interior space, a front panel, and at least one group of support members, wherein the front panel has cabinet doors, the at least one group of support members is disposed on inner sides of two side plates of the cabinet body, and each of the at least one group of support members is not provided with a detachable carrier in initial; and a computer device, connected to the cabinet body and comprising:

a section space calculation module, configured to calculate at least one storage space formed by partitioning the interior space by the detachable carrier based on a location of the detachable carrier, and detect a quantity, a size and a usage status of the at least one storage space to generate a section space status;

a section space selection module, connected to the section space calculation module, and configured to detect the object volume of a stored object before the stored object is placed into the cabinet body, select one of the unused storage spaces larger than the object volume of the stored object based on the section space status, unlock N+1 cabinet doors corresponding to the selected storage space, and prompt a specified location for disposing the detachable carrier based on a height of the stored object to partition the interior space to generate the different storage space, wherein N is a positive integer; and a confirmation module, connected to the section space calculation module and the section space selection module, wherein when the N+1 cabinet doors are detected to be closed and the stored object is placed in the selected storage space and the detachable carrier disposed newly is detected, the confirmation module drives the section space calculation module to calculate and detect the storage space to update the section space status and switch statuses of the N+1 cabinet doors to locked statuses.

2. The locker system capable of dynamically generating a storage space based on an object volume according to claim 1, wherein when selecting the storage space, the section space selection module filters out the unused storage spaces larger than the object volume of the stored object, selects the storage space having a minimal volume from the filtered unused storage spaces, and when the detachable carrier exists above the selected storage space, the section space selection module prohibits the highest one of the N+1 cabinet doors from being opened, handle comprising an elongated wire.

3. The locker system capable of dynamically generating a storage space based on an object volume according to claim 1, wherein each group of the support members comprises a pair of recessed tracks and an engagement device, recessed openings of the pair of recessed tracks face to each other in parallel, a width of the recessed opening is 2*M cm, a thickness of the detachable carrier is M cm, wherein when the detachable carrier is fully placed into the pair of recessed tracks, the engagement device engages the detachable carrier, wherein M is a positive integer.

4. The locker system capable of dynamically generating a storage space based on an object volume according to claim 1, wherein the support member is an L-shaped support member, each of two vertical sides of the detachable carrier has a recessed part, each of the recessed parts is configured to connect to an extension part at a bottom of the L-shaped support member, and the L-shaped detachable carrier is inserted into or pulled out from the L-shaped support member along a horizontal axis.

5. A locker system capable of dynamically generating a storage space based on an object volume, and the locker system comprising:

a cabinet body, comprising an interior space, a front panel, and at least one group of support members, wherein the front panel has cabinet doors, the at least one group of support members is disposed on inner sides of two side plates of the cabinet body, each of the at least one group of support members is not provided with a detachable carrier in initial; and a computer device, connected to the cabinet body, and comprising:

a section space calculation module, configured to continuously calculate at least one storage space which is remaining and available, based on a space occupied by at least one stored object placed in the interior space, and detect a quantity and a size of the at least one storage space to generate a section space status;

a section space selection module, connected to the section space calculation module, wherein before a stored object is placed, the section space selection module is configured to detect the object volume of the stored object, select one of the storage spaces larger than the object volume of the stored object, based on the section space status, and open N cabinet doors corresponding to the selected storage space, wherein N is a positive integer; and a confirmation module, connected to the section space calculation module and the section space selection module, wherein when the detachable carrier does not exist on a bottom of the selected storage space, the confirmation module prompts to dispose the detachable carrier on the bottom of the selected storage space, and when the N cabinet doors are closed, the confirmation module drives the section space calculation module to calculate and detect the storage space to update the section space status.

6. An operation method of a locker system capable of dynamically generating a storage space based on an object volume, wherein the operation method is applied in an environment where a cabinet body and a computer device are disposed, the cabinet body comprises an interior space, the operation method comprises:

disposing cabinet doors on a front panel of the cabinet body, disposing at least one group of support members on inner sides of two side plates of the cabinet body, wherein each of the at least one group of support members is not provided with a detachable carrier in initial;

calculating at least one storage space generated by partitioning the interior space by the detachable carrier based on a location of the detachable carrier, and detecting a quantity, a size and a usage status of the at least one storage space to generate a section space status, by the computer device;

before a stored object is placed into the cabinet body, detecting the object volume of the stored object, selecting one of the unused storage spaces larger than the object volume of the stored object based on the section space status, unlocking N+1 cabinet doors corresponding to the selected storage space, prompting a specified location for disposing the detachable carrier to partition the interior space to generate the different storage space based on a height of the stored object, by the computer device, wherein N is a positive integer; and when the N+1 cabinet doors are detected to be closed and the stored object is placed in the selected storage space and the detachable carrier disposed newly is detected, calculating and detecting the storage space to update the section space status, and switching statuses of the N+1 cabinet doors to locked statuses, by the computer device.

7. The operation method according to claim 6, wherein the step of selecting the storage space comprises:

filtering out the unused storage spaces larger than the object volume of the stored object;

selecting the storage space having a minimal volume from the filtered unused storage spaces; and when the detachable carrier exists above the selected storage space, prohibiting the highest one of the N+1 cabinet doors from being opened.

8. The operation method according to claim 6, wherein each group of the support members comprises a pair of recessed tracks and an engagement device, recessed openings of the pair of recessed tracks face to each other in parallel, a width of the recessed opening is 2*M cm, a thickness of the detachable carrier is M cm, wherein when the detachable carrier is fully placed into the pair of recessed tracks, the engagement device engages the detachable carrier, wherein M is a positive integer.

9. The operation method according to claim 6, wherein the support member is an L-shaped support member, each of two vertical sides of the detachable carrier has a recessed part, each of the recessed parts is configured to connect to an extension part at a bottom of the L-shaped support member, and the L-shaped detachable carrier is inserted into or pulled out from the L-shaped support member along a horizontal axis.

10. An operation method of a locker system capable of dynamically generating a storage space based on an object volume, wherein the operation method is applied in an environment where a cabinet body and a computer device are disposed, the cabinet body comprises an interior space, and the operation method comprises:

disposing cabinet doors on a front panel of the cabinet body, disposing at least one group of support members on inner sides of two side plates of the cabinet door, wherein each of the at least one group of support members is not provided with a detachable carrier in initial;

continuously calculating at least one storage space which is remaining and available based on a space occupied by at least one stored object placed in the interior space, and detecting a quantity and a size of the at least one storage space to generate a section space status, by the computer device;

before a stored object is placed, detecting the object volume of the stored object, selecting one of the storage spaces larger than the object volume of the stored object based on the section space status, and opening N cabinet doors corresponding to the selected storage space, by the computer device, wherein N is a positive integer; and when the detachable carrier does not exist on a bottom of the selected storage space, prompting to dispose the detachable carrier on the bottom of the selected storage space, and when the N cabinet doors are closed, calculating and detecting the storage space to update the section space status, by the computer device.

* * * * *